United States Patent [19]

Iijima et al.

[11] Patent Number: 4,715,790

[45] Date of Patent: Dec. 29, 1987

[54] COMPRESSOR HAVING PULSATING REDUCING MECHANISM

[75] Inventors: Takeo Iijima; Hiroshi Nomura; Susumu Saito; Susumu Echizen, all of Konan, Japan

[73] Assignee: Diesel Kiki Co., Ltd., Tokyo, Japan

[21] Appl. No.: 837,286

[22] Filed: Mar. 6, 1986

[30] Foreign Application Priority Data

Mar. 12, 1985 [JP] Japan ..... 60-48798

[51] Int. Cl.[4] ..... F04B 1/18; F04B 39/00

[52] U.S. Cl. ..... 417/269; 417/312

[58] Field of Search ..... 417/269, 312, 313

[56] References Cited

U.S. PATENT DOCUMENTS 1,927,947 9/1933 Newell ..... 417/312 X
3,876,339 4/1975 Gannaway ..... 417/312
3,934,967 1/1976 Gannaway ..... 417/312 X
4,221,544 9/1980 Ohta ..... 417/313 X
4,283,997 8/1981 Takahashi et al. ..... 417/269 X

FOREIGN PATENT DOCUMENTS 123715 9/1979 Japan ..... 417/313

*Primary Examiner*—Carlton R. Croyle
*Assistant Examiner*—Paul F. Neils
*Attorney, Agent, or Firm*—Wenderoth, Lind & Ponack

[57] ABSTRACT

A compressor of a type in which a plurality of pistons reciprocate in cylinders. A mechanism is provided to reduce pulsating of discharge pressure in the cylinder head. A high pressure chamber formed in the cylinder head is partitioned by a partition plate into a first high pressure chamber communicating with a plurality of discharge holes in the valve plate by means of a discharge valve and a second high pressure chamber communicated with a discharge opening formed in the cylinder head, and the pulsating is reduced by the passing of the gas through the first high pressure chamber and the second high pressure chamber.

4 Claims, 5 Drawing Figures

COMPRESSOR HAVING PULSATING REDUCING MECHANISM

BACKGROUND OF THE INVENTION

1. Field of the Invention

This invention relates to compressors for compressing gases such as coolant gas and the like, and more particularly to compressors having a mechanism for reducing pulsating of discharge pressure.

2. Prior Art

The compressors of a type in which a plurality of cylinder bores are formed in a cylinder block, and pistons are fitted in the cylinder bores, and the pistons are reciprocated with a predetermined phase difference by means of oblique plates and the like, are known as wobble type and swash plate type compressors and the like. In the compressors of this kind, the pulsating of the discharge pressure has heretofore been a problem. This pulsating causes a vibration of each cooling apparatus through a piping, and becomes a cause of generation of abnormal sound. For this reason, inventions for reducing the pulsating of the discharge pressure have heretofore been proposed.

One of the inventions is disclosed in Japanese Patent Laid-open Publication No. 56-44481. This invention is has a first high pressure chamber and a second high pressure chamber formed in a cylinder head portion, and this first high pressure chamber and the second high pressure chamber are communicated by means of a communicating hole, and the gas compressed in the cylinder bores is arranged to be discharged by passing sequentially through a discharge hole formed in the valve plate, a first high pressure chamber, a communicating hole, a second high pressure chamber and a discharge opening, and the pulsating of the discharge pressure is reduced by so the called muffler effect.

However, in the foregoing conventional construction, the first high pressure chamber is constructed by the valve plate and the surrounding cylinder head but the second high pressure chamber is constructed by a cover and the surrounding cylinder head which is fixed to a rear end surface of the cylinder head. Accordingly, in order to seal the second high pressure chamber from the outside, a special seal member such as an O-ring or the like must be installed between the cylinder head and the cover, and the number of component parts requiring sealing is increased, which has been a problem.

SUMMARY OF THE INVENTION

An object of this invention is to provide a mechanism for reducing pulsating of a compressor in which the second high pressure chamber is sealed by a simple means, and thus, the number of component parts can be reduced.

According to this invention, a compressor is provided in which a partition plate is provided inside of the cylinder head which partitions the cylinder head into a first high pressure chamber communicated with the discharge hole and a second high pressure chamber communicated with a discharge opening formed on the cylinder head, and the first high pressure chamber and the second high pressure chamber are communicated by means of a communicating hole formed in the partition plate.

Accordingly, the first high pressure chamber and the second high pressure chamber are formed in the cylinder head by means of the partition plate so that there is no need of a seal for the first high pressure chamber or the second high pressure chamber relative to the outside, and for this reason, the foregoing object can be achieved.

Many other advantages, features and additional objects of this invention will become manifest to those versed in the art upon making reference to the detailed description and the accompanying drawings in which preferred structural embodiments incorporating the principles of this invention are shown by way of illustrative example.

BRIEF DESCRIPTION OF THE DRAWINGS

The drawings show an embodiment of this invention.

DETAILED DESCRIPTION

Figure 1:
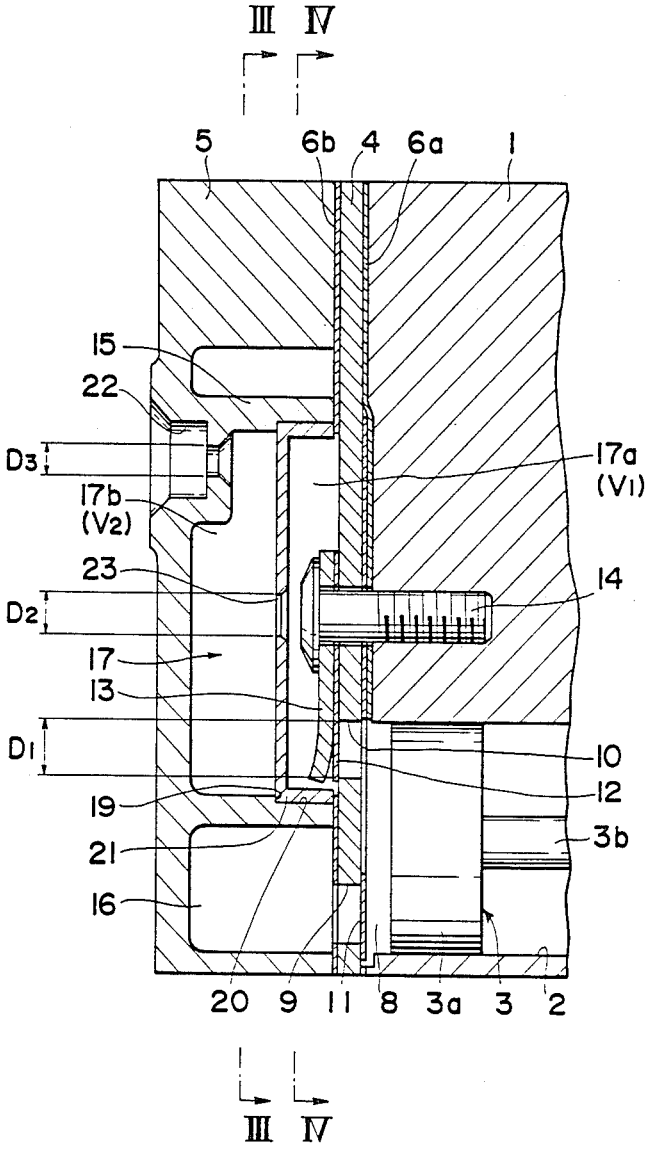
FIG. 1 is a cross section of a compressor according to the invention taken along a line I—I of FIG. 2.
Figure 2:
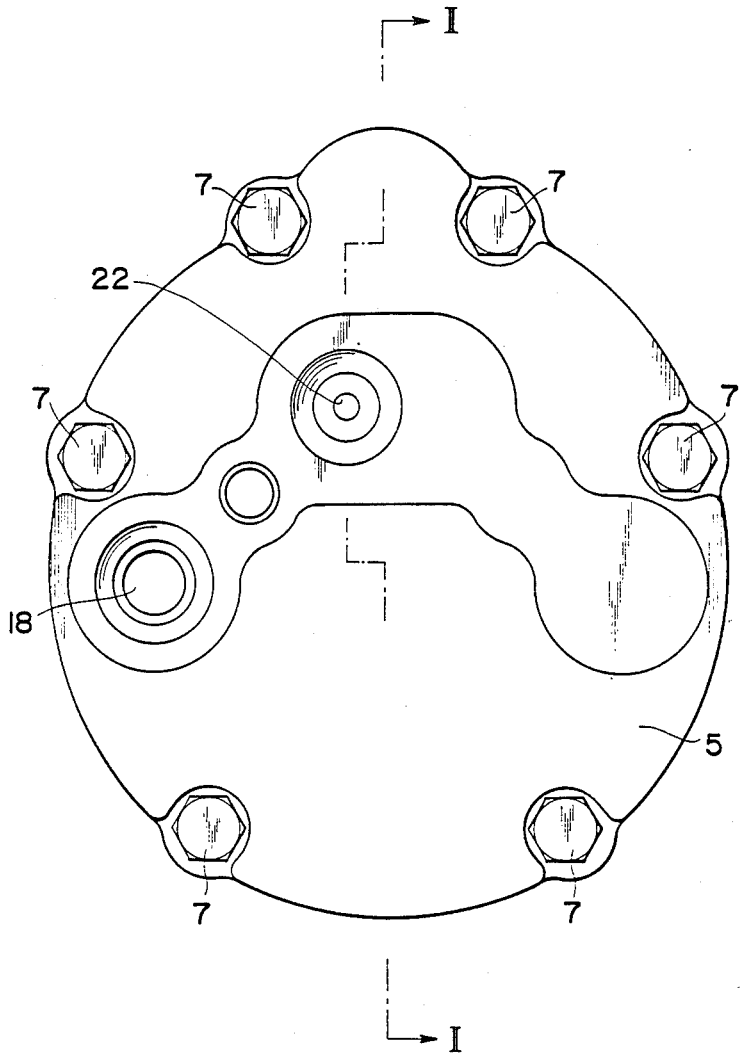
FIG. 2 is an end elevation of the compressor of FIG. 1.
Figure 3:
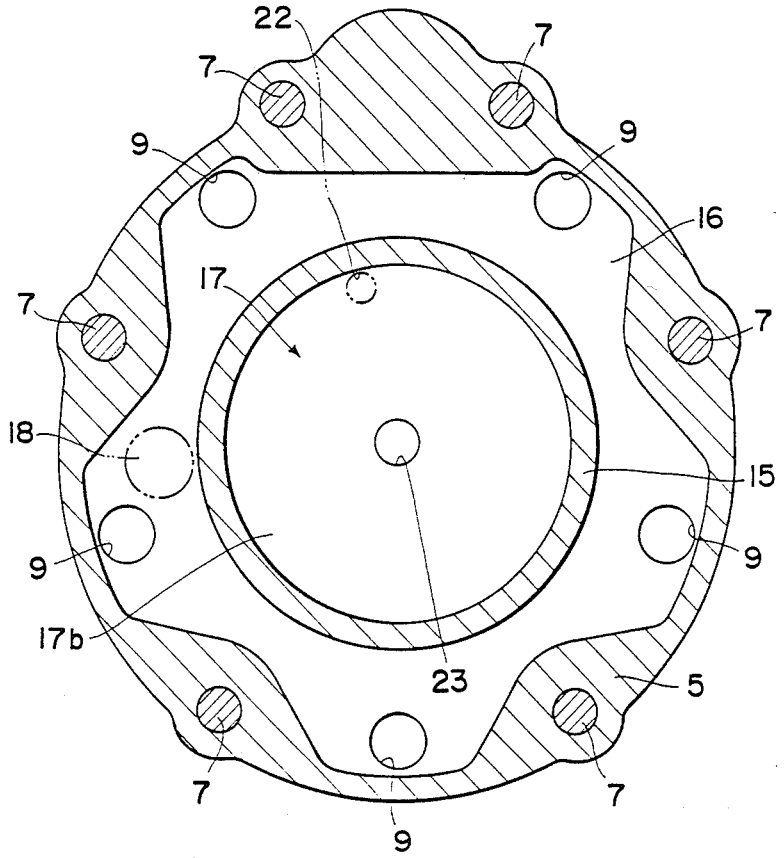
FIG. 3 is a cross section taken along a line III—III of FIG. 1.

In FIG. 1 through FIG. 5, an embodiment of this invention is illustrated, in which the compressor is a well known wobble type, and, for example, five cylinder bores 2 are formed in parallel at equal circumferential intervals in a cylinder block 1, and a piston 3*a* of a piston means 3 is slidably inserted into each cylinder bore 2. The piston 3*a* is connected to a piston rod 3*b*, and the other end of the piston rod 3*b* is connected to or abuts on an oblique plate, not shown, and the adjacent pistons 3*a* reciprocate in the cylinder bores 2 with a predetermined phase difference.

A valve plate 4 and gaskets 6*a* and 6*b* on opposite sides thereof are sandwiched between the cylinder block 1 and a cylinder head 5, to be described hereinafter by, and are fixed to one end of the cylinder block 1 together with the cylinder head 5 by means of a plurality of connecting bolts 7 thereby to close one end of the cylinder bores 2, and a compression chamber 8 is formed by each cylinder bore 2, the end surface of the piston 3*a* and the inner surface of the valve plate 4. This valve plate 4 is formed with suction holes 9 and discharge holes 10 at positions opposed to each cylinder bore 2, and for this reason, the number of sets of suction holes 9 and discharge holes 10 is five.

The suction holes 9 are closed by a star type suction valve 11 sandwiched between the valve plate 4 and one gasket 6*a*. This suction valve 11 is openable, and in the suction stroke in which the piston retreats and the volume of the compression chamber is enlarged, it opens the suction holes 9 to allow the gas to be sucked into the compression chamber 8 and in the compression stroke in which the piston 3 advances and the volume of the compression chamber 8 is reduced, it closes the suction holes 9. On the other hand, the discharge holes 10 are similarly closed by a star type discharge valve 12. Also a valve stopper 13 is disposed on the back portion of this discharge valve 12, and the discharge valve 12 is fixed to the center of the cylinder block together with the valve stopper 13 by means of a mounting screw 14. This discharge valve 12 closes the discharge holes 10 in the suction stroke and opens the discharge holes 10 in the compression stroke.

Figure 5:
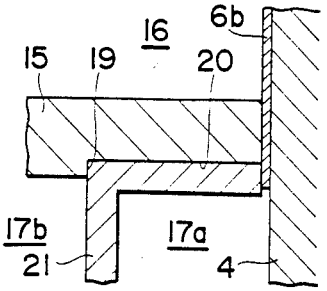
FIG. 5 is an enlarged cross section showing a seal portion between the cylinder head and the valve plate.

The hollow cylinder head 5 has integrally formed thereon a circular bulkhead 15 centering around the mounting screw 14, and the inside of the cylinder head 5, namely, the space defined by the valve plate 4 and the cylinder head 5 is partitioned into a low pressure chamber 16 on the outer peripheral edge and a high pressure chamber 17 in the middle by means of the bulkhead 15. The low pressure chamber 16 is communicated with the suction holes 9 of the valve plate 4, and is communicated with a suction opening 18 formed in the cylinder head 5. Also, on the inside of the bulkhead 15 of the cylinder head 5 is an enlarged diameter portion 20 having a step portion 19 at its inner end, and the outer periphery of a cup-shaped partition plate 21 of almost cylindrical shape and which has a bottom is lightly pressed into the enlarged diameter portion 20, and the high pressure chamber 17 is thereby partitioned into a first high pressure chamber 17*a* and a second high pressure chamber 17*b*. The peripheral edge of the bottom of the partition plate 21 abuts the step portion of the cylinder head 5, and the top edge of the cylindrical sidewall thereof abuts the gasket 6*b*. However, as shown in FIG. 5, the gasket 6*b* effects the main seal of this portion as the compression between the valve plate 4 and the bulkhead 15 is high, and the compression between the valve plate 4 and the partition plate 21 is small, and this portion is in the so called minus sealing area. This arrangement is provided to strengthen the seal between the low pressure chamber 16 and the second high pressure chamber 17*a* by increasing the degree of pressure contact of the valve plate 4 and the ends of the bulkhead 15, so that the minus sealing employed as the seal between the first high pressure chamber and the second high pressure chamber 17*b* is assured by lightly pressure inserting the partition plate 21.

The first high pressure chamber 17*a* surrounds the discharge valve 12, and is communicated with all the discharge holes 10. Also, the second high pressure chamber 17*b* is communicated with a discharge opening 22 formed in the cylinder head. The first high pressure chamber 17*a* and the second high pressure chamber 17*b* are communicated by means of a communicating hole 23 formed in the bottom portion of the partition plate 21. This communicating hole 23 is positioned in the center of the second high pressure chamber 17*b* and the discharge opening 22 is positioned in the vicinity of a peripheral edge of the second high pressure chamber 17*b*, and the distance between them is arranged to be as large as possible. As shown in FIG. 1, where the diameters of the discharge hole 9, communicating hole 23 and discharge opening 22 which are the most constricted portions are set at $D_1$, $D_2$ and $D_3$, the relationship thereof is set to be $D_1>D_2>D_3$. Furthermore, the length of the cylindrical sidewall of the partition plate 21 is set to be relatively short, and the volumes of the first high pressure chamber 17*a* and the second high pressure chamber 17*b* are set at $V_1$, $V_2$ respectively, and the relationship thereof is set as $V_2>V_1$, so that the muffler effect is improved by enlarging the rate of opening (a rate of diameters of both chambers) from the communicating hole 22 to the second high pressure chamber 17*b*.

Figure 4:
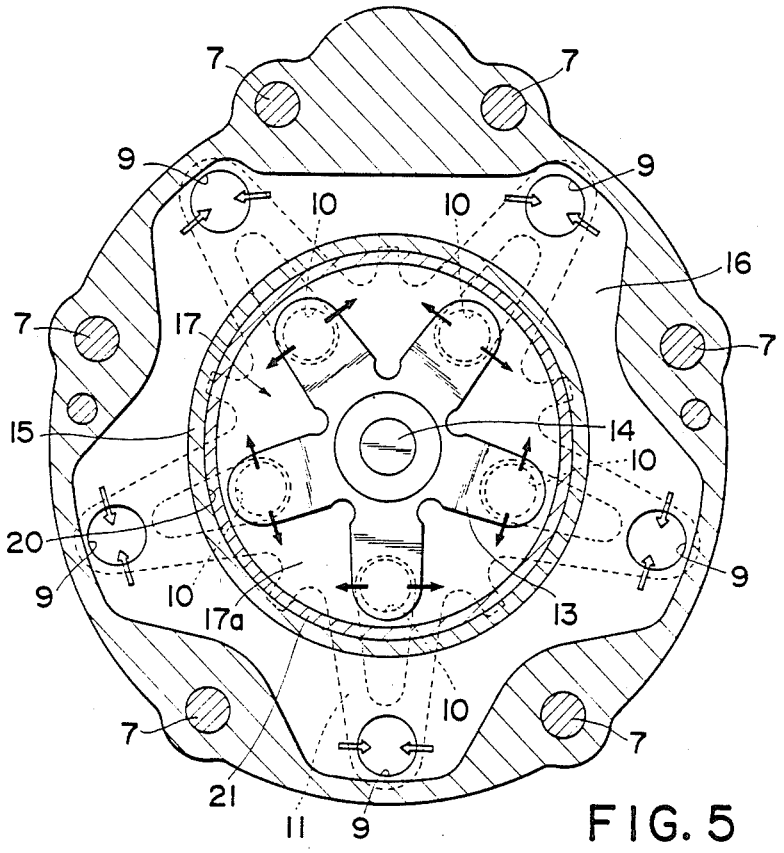
FIG. 4 is a cross section taken along a line IV—IV of FIG. 1.

Next, the operation of this Embodiment will be described in the following. In FIG. 4, the arrow mark of white-on-black shows the flow of suction gas and the arrow mark of black-on-white shows the flow of discharge gas respectively. When a drive shaft, not shown, is rotated, each piston 3*a* reciprocates in the corresponding cylinder bore 2 at a phase difference of 72 degrees with respect to the adjacent pistons. When each piston 3*a* starts the suction stroke, the volume of the compression chamber 8 is enlarged so that the pressure in the compression chamber 8 is lowered, opening the suction valve 11 to suck the gas into the compression chamber 8. At this time, the suction gas enters the low pressure chamber from the suction opening 18, and reaches the compression chamber 8 through the suction hole 9.

Next, when the discharge stroke is started, the volume of the compression chamber 8 is decreased so that the pressure in the compression chamber 8 is increased, opening the compressed valve 12 and the discharge gas that becomes the high pressure is discharged to the first high pressure chamber 17*a* from the discharge hole 10, and is stored temporarily in the first high pressure chamber 17*a*, and then, is discharged outside of the compressor from the discharge opening 22 through the second high pressure chamber 17*b* from the communicating hole 23.

In this case, the discharge gas is constricted at the time of its passing through the discharge hole 10, communicating hole 23 and discharge opening 22, and at the time of its entering the first high pressure chamber 17*a*, second high pressure chamber 17*b* and the piping connected to the discharge opening 22, it is released. Accordingly, the pulsating of discharge pressure produced by the discharge with a predetermined phase difference becomes gradually smaller by repeating the constriction and release of the discharge gas and by flowing along the curved path from opening 10 through opening 23 to opening 22. Particularly, in this Embodiment, as described in the foregoing, since the apertures $D_1$, $D_2$ and $D_3$ of the discharge hole 10, communicating hole 23 and discharge opening 22 are set in the relationship of $D_1>D_2>D_3$, the pulsating can be attenuated, and since, the pulsating of the portion passing through the communicating hole 23 becomes a problem, the volumes $V_1$ and $V_2$ of the first high pressure chamber 17*a* and the second high pressure chamber 17*b* are set as $V_2>V_1$, and the rate of release is enlarged, and the pulsating is arranged to be minimized concentrically in this portion. Also, the distances from each discharge hole 10 to the communicating hole 23 are equal, so that the pulsatings of the discharge gas discharged from each discharge hole 10 are mutually buffered to prevent them from being amplified.

Obviously, many modifications and variations of the present invention are possible in the light of above teachings. It is therefore to be understood that within the scope of the appended claims, the invention may be practiced otherwise than as specifically described.

What is claimed is:

1. A compressor having a pulsating reducing means, said compressor comprising:

a cylinder block having a plurality of cylinder bores therein;

a plurality of pistons slidable in said cylinder bores;

means connected to said pistons for driving said pistons with a predetermined phase difference between the strokes of the respective pistons;

a valve plate on one end of said cylinder block and having a plurality of sets of at least one suction hole and at least one discharge hole, one set being positioned over the end of each of said cylinder bores;

a suction valve in each suction hole for opening and closing said suction hole;

a discharge valve in each discharge hole for opening and closing said discharge hole;

a hollow cylinder head on said one end of said cylinder block over said valve plate and sandwiching said valve plate between it and said one end of said cylinder block;

said cylinder head having a discharge opening therein and a partition plate therein partitioning said cylinder head into a first high pressure chamber into which said discharge holes open and a second high pressure chamber out of which said discharge opening opens, and said partition plate having a communicating hole therein communicating said first high pressure chamber and said second high pressure chamber, the diameter $D_1$ of the smallest cross section of said discharge holes, the diameter $D_2$ of said communicating hole and the diameter $D_3$ of said discharge opening being in the relationship $D_1 > D_2 > D_3$.

2. A compressor as claimed in claim 1 in which said partition plate is fitted onto said cylinder head and contacts said cylinder head with a light pressure.

3. A compressor as claimed in claim 1 in which said communicating hole in said partition plate is positioned in the center of said second high pressure chamber, and said discharge opening in said cylinder head is positioned in the vicinity of the peripheral edge of said second high pressure chamber.

4. A compressor according to claim 1 in which the volume $V_1$ of said first high pressure chamber and the volume $V_2$ of said second high pressure chamber are in the relationship of $V_2 > V_1$.

* * * * *